US006230456B1

(12) United States Patent
Merchlewitz

(10) Patent No.: US 6,230,456 B1
(45) Date of Patent: May 15, 2001

(54) WINDOW INSERT FASTENER

(75) Inventor: Anthony W. Merchlewitz, Faribault, MN (US)

(73) Assignee: Colonial Craft, Inc., St. Paul, MN (US)

( * ) Notice: Subject to any disclaimer, the term of this patent is extended or adjusted under 35 U.S.C. 154(b) by 0 days.

(21) Appl. No.: 09/326,950

(22) Filed: Jun. 7, 1999

(51) Int. Cl.[7] ..... E06B 3/964

(52) U.S. Cl. ..... 52/204.61; 52/456; 52/656.8; 52/656.9; 411/347; 411/907; 411/908

(58) Field of Search ..... 52/204.61, 204.6, 52/456, 656.8, 656.9; 411/347, 348, 907, 908

(56) References Cited

U.S. PATENT DOCUMENTS

| | | | |
|---|---|---|---|
| 607,260 | 7/1898 | Morse . | |
| 884,481 | 4/1908 | Glaus . | |
| 2,681,481 | 6/1954 | Mason . | |
| 3,108,336 | 10/1963 | Tate . | |
| 3,221,462 | 12/1965 | Pomeroy . | |
| 3,340,661 | 9/1967 | Krieger . | |
| 3,358,412 | 12/1967 | Martin . | |
| 3,381,431 | 5/1968 | Jacobson . | |
| 3,404,499 | 10/1968 | Lewis . | |
| 3,645,058 | 2/1972 | Jacobson et al. . | |
| 3,918,202 | 11/1975 | Smith . | |
| 4,059,938 | 11/1977 | Aimar . | |
| 4,375,342 | 3/1983 | Wollar et al. . | |
| 4,648,766 | 3/1987 | Wollar . | |
| 4,687,434 | 8/1987 | Beglinger . | |
| 4,759,670 | 7/1988 | Linder et al. . | |
| 4,838,001 | 6/1989 | Battles . | |
| 5,109,647 | 5/1992 | La See . | |
| 5,174,091 | 12/1992 | Stokx . | |
| 5,437,133 | 8/1995 | Pliml . | |
| 5,487,245 * | 1/1996 | Dazo et al. | 52/456 X |
| 5,690,454 * | 11/1997 | Smith | 411/908 X |
| 5,902,085 * | 5/1999 | Yuta | 411/908 X |

FOREIGN PATENT DOCUMENTS

| | | |
|---|---|---|
| 1 428 577 | 12/1968 | (DE) . |
| 2 264 166 | 10/1975 | (FR) . |

* cited by examiner

*Primary Examiner*—Christopher T. Kent
(74) *Attorney, Agent, or Firm*—Nelson R. Capes; Rider, Bennett, Egan & Arundel

(57) ABSTRACT

A one-piece window insert fastener for releasably securing a window insert to a window sash having a generally rectangular shape with a plurality of openings about its periphery, the insert having a generally rectangular-shaped frame with a single pane structure fixed therein and having a plurality of bars each having a terminal end portion and each terminal end portion having a channel therein, the fastener being elongate and having a longitudinal axis, the fastener consisting of: a head portion adapted to engage the window sash and removably insertable into one of the openings in the window sash; a tail portion adapted to fixedly engage the window insert and removably insertable into one of the channels in the window insert; and a compression portion between the head portion and tail portion, the compression portion biasing the head portion against the window sash and allowing movement of the head portion toward the tail portion when the window insert is inserted in the window sash and moving the head portion away from the tail portion when the window insert is removed from the window sash, wherein the head portion, tail portion, and compression portion are molded in one piece from a flexible material.

17 Claims, 1 Drawing Sheet

WINDOW INSERT FASTENER

BACKGROUND OF THE INVENTION

The present invention relates to a fastener for window inserts or grids for removably attaching window inserts or grids to the sashes of windows.

Conventional windows used extensively in the construction industry generally comprise a single pane of glass carried peripherally by a window sash. It is particularly desirable at times to make the window pane appear to be comprised of a plurality of window panes carried adjacent to one another. In order to accomplish this effect, lattice window inserts often are installed adjacent window panes with the ends of the lattice strips being attached to the sash.

Several fastening methods have been employed in the past to attach lattice window inserts to window sashes. One such method, exemplified by U.S. Pat. No. 5,109,647, employs a metal clip formed of spring metal and including a frame engaging leg and a coupling leg. The frame engaging leg of each clip is secured to the window frame. The coupling leg in one embodiment has an outwardly convex outer surface which engages an angular recess in the insert with a snap coupling spring effect. In another embodiment, the coupling leg includes a rolled portion which engages an arcuate recess in the insert bar with a spring coupling action. However, it has been found that the metal grille clips in the '647 patent are difficult for the average consumer to install. Further, when the insert is removed so that the window pane can be cleaned, the grille clips are frequently misplaced or lost. In addition it has been experienced that during the installation of the spring metal grille clips between the window sash and the glass pane a stress crack condition on the glass will be created.

Another method is illustrated by U.S. Pat. No. 3,221,462. In this patent, there is disclosed a sliding fastener that is slidable in a passageway in the insert or grid, the fastener having a head that projects beyond the insert or grid into an opening in the window casement. The disadvantage of this arrangement is that the fastener must be accessible from outside the grid in order to manipulate the fastener. Thus, the fastener cannot be readily concealed within the grid, and may present an unsightly appearance.

Still another method is illustrated by U.S. Pat. No. 4,838,001, in which there is disclosed a window grid latch comprising a housing with an internal spring means that biases a pin into an opening in the window frame. A finger operated handle is used to slide the pin into and out of the housing. As in the '462 patent, the latch thus cannot be readily concealed in the window grid, presenting an unsightly appearance. The device is also complex, requiring a separate spring and an internal latch in the housing to retain the pin in the retracted position.

Another complex device for fastening a window grid to a window frame is shown in U.S. Pat. No. 5,437,133. This is a multi-piece part with a spring-loaded plunger assembly and a base portion movably secured to the plunger assembly. Exact molding of the parts is necessary to make sure that the plunger assembly can engage a radial shoulder on the base by means of a mating flange on the plunger assembly. The coil spring is a separate part and must be installed into the base and plunger. It appears that the coil spring or the plunger may break after repeated use, making the fastener unusable.

There is a need for a simple, inexpensive, one-piece window insert fastener that does not require an external handle to operate, is readily concealable within the window insert, and which is not readily lost when the window insert is removed to clean the window.

SUMMARY OF THE INVENTION

A one-piece window insert fastener for releasably securing a window insert to a window sash having a generally rectangular shape with a plurality of openings about its periphery, the insert having a generally rectangular-shaped frame with a single pane structure fixed therein and having a plurality of bars each having a terminal end portion and each terminal end portion having a channel therein, the fastener being elongate and having a longitudinal axis, the fastener consisting of: a head portion adapted to engage the window sash and removably insertable into one of the openings in the window sash; a tail portion adapted to fixedly engage the window insert and removably insertable into one of the channels in the window insert; and a compression portion between the head portion and tail portion, the compression portion biasing the head portion against the window sash and allowing movement of the head portion toward the tail portion when the window insert is inserted in the window sash and moving the head portion away from the tail portion when the window insert is removed from the window sash, wherein the head portion, tail portion, and compression portion are molded in one piece from a flexible material.

A principal object and advantage of the present invention is that it is molded in one piece from a flexible material, and is therefore inexpensive and simple to manufacture.

Another principal object and advantage of the present invention is that it does not require an external handle to latch the window insert into the window frame, and therefore the fastener is invisible once the window insert is inserted in the window frame.

Another principal object and advantage of the present invention is that the fastener is retained within the window insert when the window insert is removed from the window frame, and thus is not easily misplaced or lost.

DETAILED DESCRIPTION OF THE PREFERRED EMBODIMENTS

Figure 1:
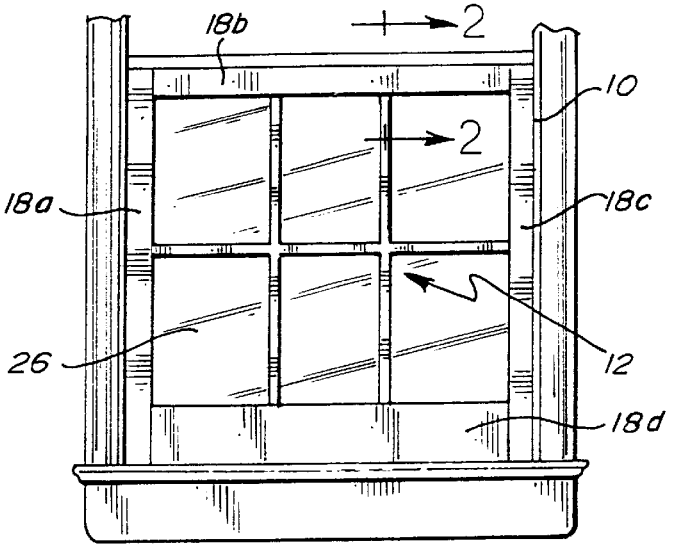
FIG. 1 is a front elevational view of a conventional window having a wooden insert secured thereto by an insert fastener, constructed in accordance with the principals of the present invention.
Figure 1A:
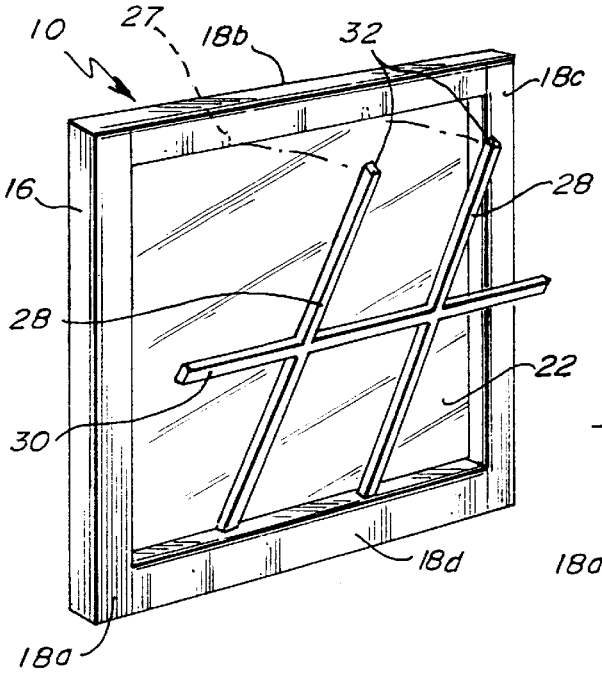
FIG. 1A is a perspective view similar to FIG. 1, but illustrating how the insert may be installed in the window.
Figure 2:
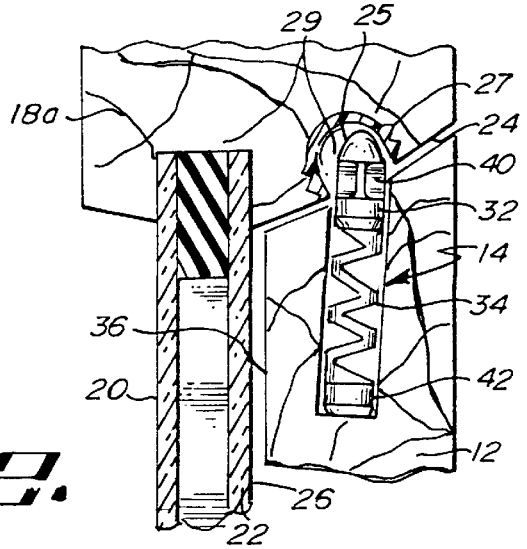
FIG. 2 is a cross-sectional view taken along the lines 2—2 of FIG. 1.

Referring now to FIGS. 1, 1A, and 2, there is shown a conventional window sash 10 having an ornamental wooden insert 12 secured thereto by an insert fastener 14, constructed in accordance with the principles of the present invention. The window sash 10 includes a generally rectangularly-shaped sash frame 16 formed of sash frame members 18*a*–18*d* which are joined to each other in a right angular relationship. A single pane structure formed of transparent spaced apart window panes 20 and 22, such as glass, is mounted vertically and recessed within the window sash 10 in a conventional manner. It will be noted that each of the panes 20 and 22 is a solid single pane extending across the full expanse of the sash 10.

In order to simulate the effect of multiple window glass panes from the single pane structure, the insert 12 is provided for releasable attachment to the sash frame 16. The sash frame 16 is provided with a chamfered surface 24 spaced from the flat surface 26 of the innermost pane 22 and extends substantially about the interior periphery of the frame 16. The chamfered surface 24 is formed with a plurality of openings 25 for receiving the a grille strike 27. The grille strike is in the form of a plastic grommet with a punch-away center disc section 29 which is pre-installed in each of the sash frame members 18*a*–18*d*. When the center disc section 29 is removed, there is created a hollow-type grommet.

The insert 12 is comprised of a plurality of vertical bars 28 and a horizontal bar 30. The vertical bars 28 and the horizontal bar 30 are relatively arranged to form the insert according to the configuration of the number of multiple window panes desired to be simulated. These bars are tenoned at their points of intersection. Each of the vertical and horizontal bars 28, 30 has a flat inner surface 36 which engages the flat surface 26 of the innermost pane 22. Further, each of the vertical and horizontal bars includes a terminal end portion 32 at each end thereof. Each of the terminal end portions 32 has a channel 34 which may be drilled into the terminal end portion 32 of each one of the vertical and horizontal bars.

In order to releasably secure the insert 12 to the sash frame 16, the insert fastener 14 of the present invention is inserted into each of the channels 34. When so engaged, as shown in FIG. 2, the insert fastener 14 co-operates with the grille strike so as to hold the flat inner surface 36 of the vertical and horizontal bars tightly against the flat surface 26 of the innermost pane 22, thereby effecting the simulation of multiple glass panes.

Figure 3:
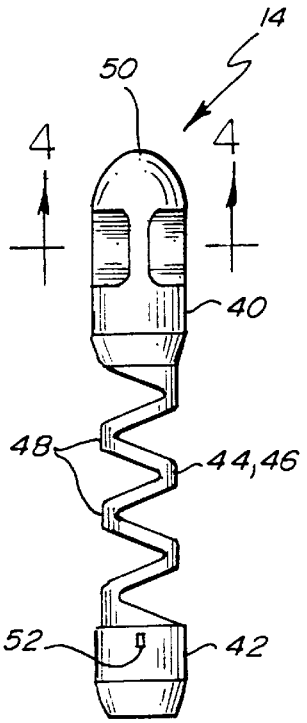
FIG. 3 is a side elevational view of the fastener of the present invention.

FIG. 3 shows the detailed construction of the insert fastener 14, which comprises a head portion 40, a tail portion 42, and a compression portion 44 between the head portion 40 and tail portion 42. As can be seen in FIG. 2, the head portion 40 engages the window sash frame member 18*a*–18*d* and is removably insertable into one of the openings 25, contacting the grille strike 27. The tail portion 42 is fixedly engaged to the window insert 12 and is removably insertable into the channel 34. When engaged as in FIG. 2, the compression portion 44 biases the head portion against the window sash 16, allowing the head portion to gradually move toward the tail portion as the window insert 12 is inserted in the sash 16. When disengaged, as in FIG. 1A, the compression portion moves the head portion 40 away from the tail portion 42, so that the head portion 40 partially protrudes from the terminal end portion 32.

The head portion 40, tail portion 42, and compression portion 44 are molded in one piece from a flexible material, preferably a plastic material, and most preferably nylon. It will be seen that there is no separate compression spring, as in the '133 patent.

As can be seen in FIG. 3, the compression portion 44 further comprises a serpentine piece 46 with a plurality of folds 48 transverse to the longitudinal axis of the fastener 14. As will be apparent to one skilled in the art, the serpentine piece 46 may be compressed by forcing the folds 48 toward one another. Because the folds are normally biased away from one another by the elasticity of the flexible material, the serpentine piece 46 will be restored to the configuration shown in FIG. 3 when pressure is removed from the head portion.

It can also be seen from the Figures that the fastener 14 is substantially contained within the channel 34 of the terminal end portion 32 and has no external handle for moving the head portion 40 toward the tail portion 42. This is not necessary, as the head portion 40 will be forced toward the tail portion 42 as the window insert 12 is inserted in the frame 16. The absence of such a protruding handle means that the fastener 14 is not visible once the window insert 12 is inserted in the frame 16.

It can be seen from FIG. 3 that the head portion 40 is of constant diameter and tapers toward a rounded tip 50. Thus, the head portion is unlikely to fracture under the pressure caused by insertion of the insert 12 into the frame 16.

The fastener 14 also preferably comprises a plurality of projections 52 on the tail portion 42 for engagement with the channel 34, thereby retaining the tail portion 42 within the window insert 12.

Figure 4:
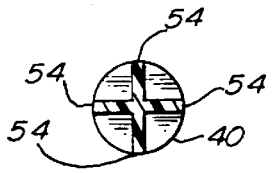
FIG. 4 is a cross-sectional view taken along the lines 4—4 of FIG. 3.

As can be seen in FIG. 4, the head portion 40 preferably has a number of vanes 54 for engaging the grille strike 27.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A one-piece window insert fastener for releasably securing a window insert to a window sash having a generally rectangular shape with a plurality of openings about its periphery, the insert having a generally rectangular-shaped frame with a single pane structure fixed therein and having a plurality of bars each having a terminal end portion and each terminal end portion having a channel therein, the fastener being elongate and having a longitudinal axis, the fastener comprising:

a) a solid, unitary head portion adapted to engage the window sash and removably insertable into one of the openings in the window sash;

b) a tail portion adapted to fixedly engage the window insert and removably insertable into one of the channels in the window insert; and c) a non-removable compression portion between the head portion and tail portion, the compression portion biasing the head portion against the window sash and allowing movement of the head portion toward the tail portion when the window insert is inserted in the window sash and moving the head portion away from the tail portion when the window insert is removed from the window sash wherein the head portion, tail portion, and compression portion are molded in one piece from a flexible material and are of substantially the same diameter.

2. The window insert fastener of claim 1, wherein the compression portion further comprises a serpentine piece with a plurality of folds transverse to the longitudinal axis of the fastener, whereby the serpentine piece may be compressed by forcing the folds toward one another, the folds being normally biased away from each other by the elasticity of the flexible material.

3. The window insert fastener of claim 1, having no external handle for moving the head portion toward the tail portion to remove the window insert from the window sash.

4. The window insert fastener of claim 1, wherein the head portion is of constant diameter throughout its length and tapers to a rounded tip.

5. The window insert fastener of claim 1, further comprising a plurality of projections on the tail portion for engagement with the channel, thereby retaining the tail portion within the window insert.

6. The window insert fastener of claim 1, wherein the flexible material is a plastic material.

7. The window insert of claim 6, wherein the plastic material is nylon.

8. A one-piece window insert fastener for releasably securing a window insert to a window sash having a generally rectangular shape with a plurality of openings about its periphery, the insert having a generally rectangular-shaped frame with a single pane structure fixed therein and having a plurality of bars each having a terminal end portion and each terminal end portion having a channel therein, the fastener being elongate and having a longitudinal axis, the fastener comprising:

a) a solid, unitary head portion adapted to engage the window sash and removably insertable into one of the openings in the window sash;

b) a tail portion adapted to fixedly engage the window insert and removably insertable into one of the channels in the window insert; and c) a non-removable compression portion between the head portion and tail portion, the compression portion biasing the head portion against the window sash and allowing movement of the head portion toward the tail portion when the window insert is inserted in the window sash and moving the head portion away from the tail portion when the window insert is removed from the window sash wherein the head portion, tail portion, and compression portion are molded in one piece from a flexible material and are of substantially the same diameter; and wherein the compression portion further comprises a serpentine piece with a plurality of folds transverse to the longitudinal axis of the fastener, whereby the serpentine piece may be compressed by forcing the folds toward one another, the folds being normally biased away from each other by the elasticity of the flexible material.

9. The window insert fastener of claim 8, having no external handle for moving the head portion toward the tail portion to remove the window insert from the window sash.

10. The window insert fastener of claim 8, wherein the head portion is of constant diameter throughout its length and tapers to a rounded tip.

11. The window insert fastener of claim 8, further comprising a plurality of projections on the tail portion for engagement with the channel, thereby retaining the tail portion within the window insert.

12. The window insert fastener of claim 8, wherein the flexible material is a plastic material.

13. The window insert of claim 12, wherein the plastic material is nylon.

14. A one-piece window insert fastener for releasably securing a window insert to a window sash having a generally rectangular shape with a plurality of openings about its periphery, the insert having a generally rectangular-shaped frame with a single pane structure fixed therein and having a plurality of bars each having a terminal end portion and each terminal end portion having a channel therein, the fastener being elongate and having a longitudinal axis, the fastener comprising:

a) a solid, unitary head portion adapted to engage the window sash and removably insertable into one of the openings in the window sash;

b) a tail portion adapted to fixedly engage the window insert and removably insertable into one of the channels in the window insert; and c) a non-removable compression portion between the head portion and tail portion, the compression portion biasing the bead portion against the window sash and allowing movement of the head portion toward the tail portion when the window insert is inserted in the window sash and moving the head portion away from the tail portion when the window insert is removed from the window sash wherein the head portion, tail portion, and compression portion are molded in one piece from a plastic material and are of substantially the same diameter;

wherein the compression portion further comprises a serpentine piece with a plurality of folds transverse to the longitudinal axis of the fastener, whereby the serpentine piece may be compressed by forcing the folds toward one another, the folds being normally biased away from each other by the elasticiy of the flexible material; and wherein the head portion is of constant diameter throughout its length and tapers to a rounded tip.

15. The window insert fastener of claim 14, having no external handle for moving the head portion toward the tail portion to remove the window insert from the window sash.

16. The window insert fastener of claim 14, further comprising a plurality of projections on the tail portion for engagement with the channel, thereby retaining the tail portion within the window insert.

17. The window insert of claim 14, wherein the plastic material is nylon.

* * * * *

UNITED STATES PATENT AND TRADEMARK OFFICE

CERTIFICATE OF CORRECTION

PATENT NO. : 6,230,456 B1
DATED : May 15, 2001
INVENTOR(S) : Anthony W. Merchlewitz It is certified that error appears in the above-identified patent and that said Letters Patent is hereby corrected as shown below:

Column 6,
Line 24, cancel "bead" and substitute therefor -- head --.

Signed and Sealed this

Twenty-first Day of May, 2002

*Attest:*

*Attesting Officer*

JAMES E. ROGAN
*Director of the United States Patent and Trademark Office*